US007810770B2

(12) United States Patent
Treadwell

(10) Patent No.: US 7,810,770 B2
(45) Date of Patent: Oct. 12, 2010

(54) STORAGE RACK PALLET SUPPORT BAR AND METHOD OF ITS MANUFACTURE

(76) Inventor: Charles R. Treadwell, 5556 Clarks Bridge Rd., Clermont, GA (US) 30527

( * ) Notice: Subject to any disclaimer, the term of this patent is extended or adjusted under 35 U.S.C. 154(b) by 1176 days.

(21) Appl. No.: 11/439,258

(22) Filed: May 24, 2006

(65) Prior Publication Data

US 2007/0271794 A1 Nov. 29, 2007

(51) Int. Cl.
*F16M 11/00* (2006.01)

(52) U.S. Cl. ..... 248/200; 248/300

(58) Field of Classification Search ..... 248/200, 248/300, 200.1; 211/151
See application file for complete search history.

(56) References Cited

U.S. PATENT DOCUMENTS 5,312,004 A * 5/1994 Krummell et al. ..... 211/151
5,489,171 A * 2/1996 Claps et al. ..... 410/26
6,357,713 B1 * 3/2002 BeBow ..... 248/300
2005/0067541 A1 * 3/2005 Dinh et al. ..... 248/200

* cited by examiner

*Primary Examiner*—Ramon O Ramirez
(74) *Attorney, Agent, or Firm*—Ronald E. Greigg

(57) ABSTRACT

A parallel support bar for use on a vertical storage rack is roll formed from a single blank of flat metal plate to provide an elongated body portion having a generally rectangular channel shaped cross section with one open corner. The body includes a horizontal top flange with a narrow vertical flange extending downward from one edge and a web extending downward from its other edge, and a narrow horizontal flange extend inwardly from the bottom edge of the web. A mounting bracket is integrally formed each end of the bar by shaping the end portion of the rolled body.

7 Claims, 3 Drawing Sheets

STORAGE RACK PALLET SUPPORT BAR AND METHOD OF ITS MANUFACTURE

BACKGROUND OF THE INVENTION

1. Field of the Invention

This invention relates to an improved pallet support bar for structural storage racks, and more particularly to such a support bar integrally formed from a single piece of sheet metal.

2. Description of the Prior Art

Storage rack systems are well known and widely used for storage of product or machines in multiple tiers for easy access in warehouses, shipping facilities, and even in retail facilities. Such systems are frequently employed for storage of pallets of product and will be refined to herein with reference to pallet storage, although it is understood that such systems are also widely used for other products such as bundles of pipes, stacks of lumber, rolls of carpet, appliances, large containers or boxes and the like.

The most widely used pallet storage rack systems consists of an open frame structure constructed of rolled steel shapes including vertical columns or post with horizontal support beams secured to the posts at different levels and with suitable cross bracing to provide stability to the multi-level frame structure. Pallets are loaded onto the racks and removal therefrom through rectangular openings defined by each adjacent pair of posts and support beams. To enable pallets or loads of different sizes to be stored in the racks, and to assure against a misplaced pallet, i.e., a pallet not sitting on both the front and back support beams, from falling through the rack, pallet supports bars are mounted on and extend between the front and back beams at each tier or level. The pallet support bars are elongated structural members and are usually mounted in pairs between adjacent posts along the length of the rack, with their top surface coplanar with the top surface of the support beams.

The pallet support bars employed in the known pallet storage systems generally have been fabricated from rolled structural steel sections such as structural angles or channels, with mounting brackets joined by welding to each end for bolting to the vertical face or web of the front and rear support beams. Such pallet support bars are heavy and expensive to fabricate.

It is therefore the object of the present invention to provide a pallet support bar for a storage rack system which is lighter in weight, cheaper to manufacture and adds has more load support capacity than the known structural pallet supports bars.

Another object is to provide such a pallet support bar which is integrally formed from a single piece of flat steel stock.

Another object is to provide such a pallet support bar which does not require wielding.

Another object is to provide such a pallet support bar having an integrally formed mounting bracket at each end.

SUMMARY OF THE INVENTION

The foregoing and other objects are attained in a pallet support bar which is roll-formed from an elongated strip of flat steel sheet or plate. To form the support bar, a running length of steel strip is trimmed as by a roller-die cutting operation to cut away a portion from one edge in the area which will become the ends of the individual supports bars. The strip is then roll formed into the desired cross-sectional configuration to provide the necessary beam strength, and then divided into individual blanks by cutting the rolled shape at the center of each cut-away portion. The free ends of the cut-away portions are then bent and formed to provide an integral mounting bracket at each end, with a mounting wall of each bracket extending perpendicular to the longitudinal axis of the supports bars. In the roll-forming operation, the steel strip is formed into a shape which may be described as generally rectangular with one corner and a portion only of the adjacent sides removed. It has been found that the unitary structure formed into this configuration from flat steel plate has the required beam strength, is substantially lighter and can be manufactured at substantially less costs than the known supports fabricated from structural shapes as described above.

BRIEF DESCRIPTION OF THE DRAWINGS

The foregoing features and advantages of the invention will become apparent from the detailed description contained herein below, taken in conjunction with the drawings, in which.

DESCRIPTION OF THE PREFERRED EMBODIMENTS

Figure 1:
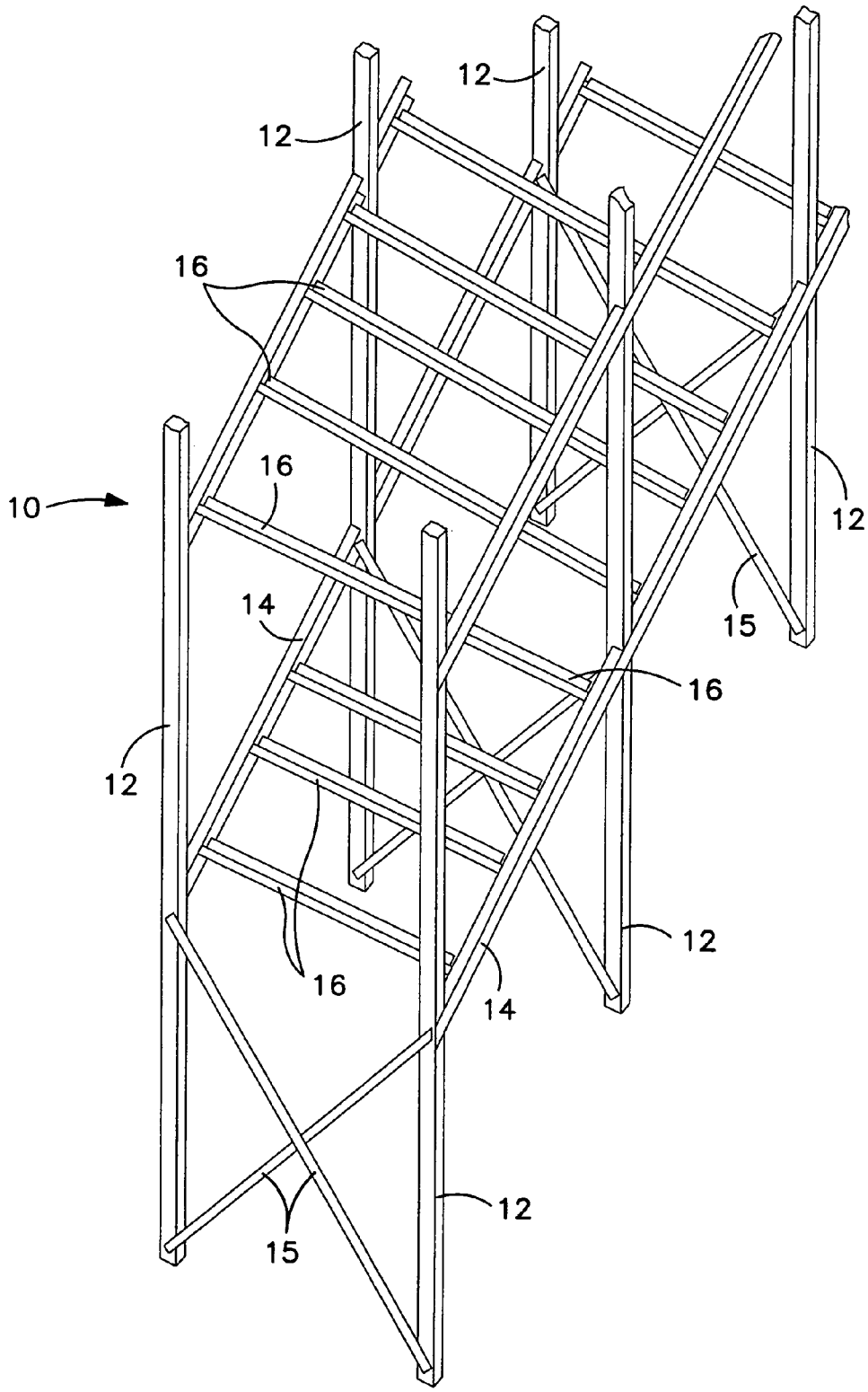
FIG. 1 is a fragmentary, perspective view of a pallet storage system with which the pallet support arms of the invention are used.

Referring now to the drawings in detail, a known commercial storage rack of the type with which the present invention is used is designated generally by the reference number 10, and includes a plurality of vertical standards, or posts 12 spaced from one another in front and back rows, with front and rear horizontal support beams 14 extending between adjacent posts in each row at spaced levels. Suitable cross bracing, indicated generally at 15, extends between the posts in the two rows to provide structural stability to the rack, while leaving the space open between adjacent posts 12 in the front and back rows and between the pallet support beam 14 at successive levels to provide access for depositing and removing pallets. Cross bracing 11 preferably provided at each storage level, but is only shown at the first level in FIG. 1 to simplify the drawing.

A plurality of elongated pallet support bars 16 extend between and have their ends mounted, as by bolts, not shown, on the vertical units of the front and rear support beams at each level.

Figure 2:
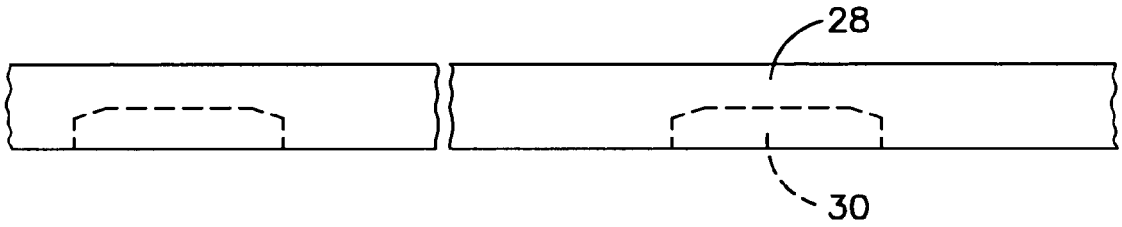
FIG. 2 is a plain view of a portion of steel strip used to produce the pallet support bar of the invention, with portions to be cut away adjacent each end designated by broken lines.
Figure 3:
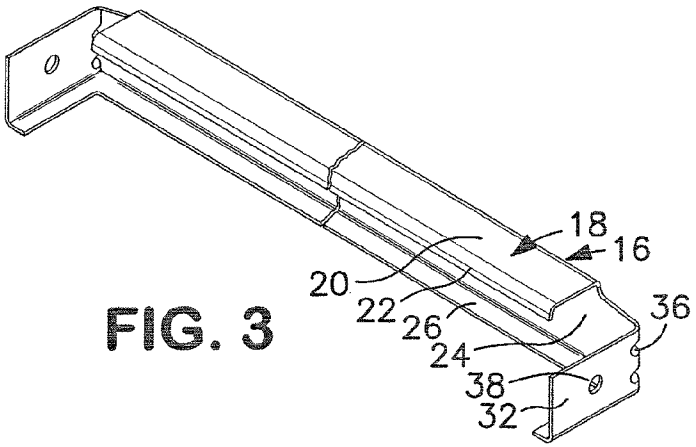
FIG. 3 is an isometric view of a pallet support arm according to the invention.
Figure 7:
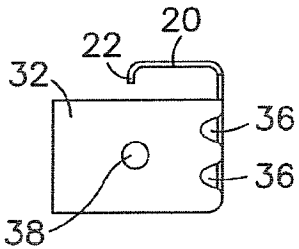
FIG. 7 is an end elevation view thereof.
Figure 4:
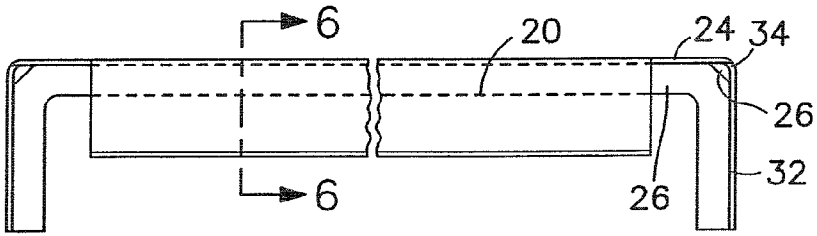
FIG. 4 is a top plain view of the support arm shown in FIG. 3.
Figure 5:
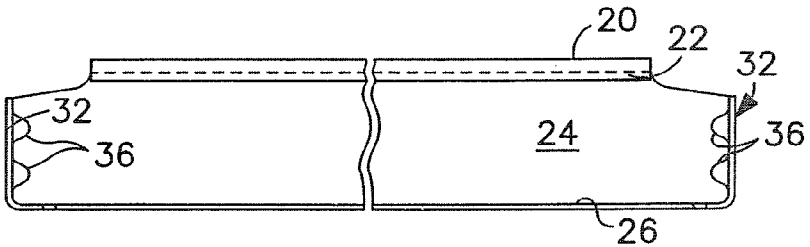
FIG. 5 is a front elevation view of the support arm shown in FIGS. 3 and 4.

As best seen in FIG. 3, each pallet support bar 16 of the present invention includes an elongated body portion 18 defined by a horizontal top flange 20 having a first, relatively narrow down-turned flange 22 extending along one edge thereof and a vertical web 24 extending downwardly from its other edge. Web 24 terminates in a second, relatively narrow inwardly turned flange 26 extending from its bottom edge along the entire length of the web. The top flange 20, first flange 22, web 24, and second flange 26 are roll-formed from an elongated strip 28 of steel plate (FIG. 2), with the adjacent edges of the webs and flanges being joined by relatively short radius bends defining three corners of the elongated, four-sided, open channel-like body potion 18. Also as seen in FIG. 2, portions 30 of the strip are cut away in the area which will become the ends of the support bar before roll forming so that in the roll-formed bar 16, the top flange 20 and first vertical flange 22 terminate a short distance from the end of the arm as explained more fully herein below.

Figure 6:
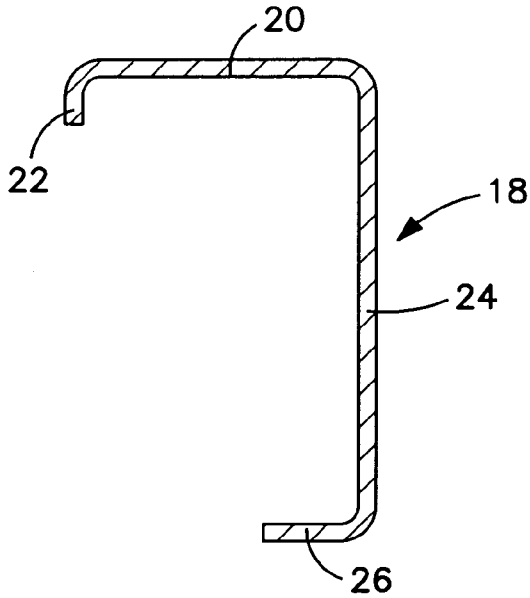
FIG. 6 is a sectional view taken along lines 6-6 of FIG. 4.

As most clearly seen in FIG. 6, the top flange 20 and vertical web 24 have the general configuration of a conventional rolled angle, but the short vertical flange 22 on the edge of the top flange 20 opposite web 24, and the second flange 26 on the bottom edge of web 24 provide substantial strength to the arm both in bending and in torsion. This enables a substantial reduction in weight of the arm 16 over the conventional construction employing rolled structural members without sacrificing strength or stability. The "open-corner" rectangular channel cross sectional configuration of the arm body 18 also enables easy shaping of the flat blanks 28 in a single-pass roll forming operation.

In order to facilitate roll forming, it is preferred that the vertical height of the short flange 22 not exceed about one third, and more preferably about one fourth the overall height of the support arm. Also, the transverse width of the second or bottom flange 26 preferably has a width no greater than about one half, and more preferably no greater than about one third the total width of the support beam.

Referring to FIG. 2, the cut-away portions 30 of the strip 28 when severed into individual roll-formed blanks results in the end portions of the web 24 and the second narrow flange 26 extending past the top flange 20 and first narrow flange 22. After the strip is roll formed and cut into blanks these end portions are subjected to a forming operation in which the web 24 and second flange 26 are bent about a vertical axis to extend at right angles to the web 26 and define an end mounting bracket, or flange 32. In this operation, the relatively narrow flange 26 is restrained so as to be shaped into a continuous, inwardly directed flange around the angled bend 34, thereby strengthening and reinforcing the connection between the mounting bracket 32 and the body 18 of the arm 16. Alternatively, a V-shaped notch may be formed in the flange 26 before bending, and the edges of the notch welded together after bending, although this increases the production cost and reduces the strength of the bar. Also, in the mounting bracket forming operation, the metal at the angled bend 34 is deflected inwardly at at least one, and preferably, two locations to in effect form integral reinforcing gussets 36 between the web 24 and mounting bracket 32. It is also pointed out that one or more mounting openings, or bolt holes 38 are formed in each mounting bracket, which mounting openings are preferable initially formed in the strip 30 simultaneously with the strip trimming operation.

While a preferred embodiment of the invention has been disclosed and described, it should be understood that the invention is not limited thereto, but rather that it is intended to include all embodiments which would be apparent to one skilled in the art and which come within the spirit and scope of the invention.

I claim:

1. An elongated pallet support bar for use in a vertical storage rack system, the pallet support bar comprising, an elongated body portion formed from a flat metal blank and having an open-cornered, generally rectangular channel-shaped cross section defined by a horizontal top flange, a vertical web having its top edge integral with one side edge of the top web, a first flange integral with and extending downward from the other side edge of the top flange in spaced, generally parallel relation to the web, and a second flange integral with and extending inwardly from the bottom edge of the web in generally parallel relation to the top flange, a mounting bracket on each end of the body portion, each said mounting bracket being integrally formed with the web and the second flange and including a flat end surface extending substantially perpendicular to the longitudinal axis of the body portion, and at least one mounting opening formed in each said flat end surface for receiving a fastening element to mount the arm to a vertical support post of the storage rack system.

2. The elongated pallet support bar of claim 1, wherein the transverse width of the second flange is no greater than about one half the transverse width of the top flange.

3. The elongated pallet support bar of claim 2, wherein the vertical height of the first flange is no greater than about one fourth of the vertical height of the vertical web.

4. The elongated pallet support bar of claim 1, wherein the transverse width of the second flange is no greater than about one third the transverse width of the top flange.

5. The elongated pallet support bar of claim 1, wherein the vertical height of the first flange is no greater than about one fourth of the vertical height of the vertical web.

6. The elongated pallet support bar of claim 1, wherein said top flange and said first web terminate at a location spaced from the mounting bracket at each end of the pallet support bar.

7. The elongated pallet support bar of claim 6, further comprising reinforcing gussets integrally formed with said vertical web and said flat end surface for reinforcing said mounting brackets.

* * * * *